US007444828B2

(12) United States Patent
Kadowaki et al.

(10) Patent No.: US 7,444,828 B2
(45) Date of Patent: Nov. 4, 2008

(54) ICE DISCHARGING STRUCTURE OF ICE MAKING MECHANISM

(75) Inventors: Shizuma Kadowaki, Toyoake (JP); Kunihiko Ishitomi, Toyoake (JP); Masaaki Kawasumi, Toyoake (JP); Hiroki Imaoka, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 314 days.

(21) Appl. No.: 11/291,376

(22) Filed: Nov. 30, 2005

(65) Prior Publication Data

US 2007/0119202 A1 May 31, 2007

(51) Int. Cl.
*F25C 5/18* (2006.01)

(52) U.S. Cl. ..... 62/344; 137/527.8

(58) Field of Classification Search ..... 62/344; 137/527.8

See application file for complete search history.

(56) References Cited

U.S. PATENT DOCUMENTS 2,767,735 A * 10/1956 Darling ..... 137/527
3,815,629 A * 6/1974 Oberholtzer ..... 137/527.8
4,128,111 A * 12/1978 Hansen et al. ..... 137/515.7
4,191,205 A * 3/1980 Nash ..... 137/375
4,296,772 A * 10/1981 Nilsson ..... 137/269.5
4,321,942 A * 3/1982 Duggan ..... 137/218
4,867,802 A * 9/1989 Earl ..... 137/526
6,199,576 B1 * 3/2001 Young ..... 137/242
6,220,282 B1 * 4/2001 Powell ..... 137/512
6,264,452 B1 * 7/2001 Sun et al. ..... 418/270
6,397,874 B1 * 6/2002 Featheringill et al. ..... 137/14

FOREIGN PATENT DOCUMENTS

JP 2002-228311 8/2002
JP 2003-042608 2/2003

* cited by examiner

*Primary Examiner*—William E Tapolcai
(74) *Attorney, Agent, or Firm*—William L. Androlia; H. Henry Koda

(57) ABSTRACT

An ice discharging structure of an ice making mechanism for discharging an ice block from the ice making mechanism reliably regardless of the weight of the ice block.

An ice making mechanism of an ice making machine comprises an ice making section case in which an opening closed by a separator openably and closably is provided. The ice making section case comprises an ice chute inclined downward to the opening of the ice making section case, provided between an ice making section 16 and a sprinkler, for leading an ice block fallen from an ice making chamber to the opening. On an end face of the ice chute, a first rib is horizontally provided in a width direction of the end face, and a top thereof is in line contact with an inner face of the separator.

3 Claims, 14 Drawing Sheets

ICE DISCHARGING STRUCTURE OF ICE MAKING MECHANISM

BACKGROUND OF THE INVENTION

1. Field of the Invention

The present invention relates to an ice discharging structure of an ice making mechanism, for example, an ice discharging structure of an ice making mechanism of an open cell type automatic ice making machine which supplies ice making water by spraying from below on a large number of ice making chambers opening downward so as to make ice blocks continuously.

2. Description of the Related Art

An spray type automatic ice making machine which supplies ice making water by spraying from below on a large number of ice making chambers opening downward so as to make ice blocks continuously is widely used in a kitchen of facilities such as a coffee shop, a restaurant or the like. As shown in FIG. 13 or 14, for an ice making mechanism 10 of the spray type automatic ice making machine, an ice making mechanism, called "open cell type", which makes ice while an ice making chamber 18 is opened during the ice making process, is available. The ice making mechanism 10 comprises a box-like ice making section case 12 on one side of which an opening 12*a* is provided. Below the ice making section case 12, an ice making water tank 24 for retaining ice making water W is provided so that the lower end portion of the ice making section case 12 is inserted in the ice making water tank 24. Inside the ice making section case 12, a sprinkler 26 which has a plurality of water sprinkling nozzles 28 for spraying ice making water W upward is provided on the lower side, and an ice making section 16 having a plurality of ice making chambers 18 opening downward corresponding to the water sprinkling nozzles 28 is provided on the upper side in the ice making section case 12. On the top face of the ice making section 16, an evaporation pipe 20 communicating with a refrigerating system (not shown) is meanderingly arranged in tight contact so as to cool the ice making chamber 18 forcibly by circulating a coolant therethrough during the ice making operation.

In addition, in the ice making section case 12, between the ice making section 16 and the sprinkler 26, a duckboard-like ice chute 22 which opens toward the top of the water sprinkling nozzle 28 is provided, inclined downward to the opening 12*a* of the ice making section case 12. In the opening 12*a*, a plurality of separators 14 rockably engaged with the ice making section case 12 by their upper end portions are arranged in parallel with the width direction of the opening 12*a*. The separator 14, which is normally hanged down by gravity, closes the opening 12*a* by bringing an inner face 14*a* of the open end (lower end portion) of the separator 14 into contact with an opposing end face 22*a* of the ice chute 22 (for example, see Japanese Unexamined Patent Publication No. 2002-228311). Furthermore, a pumping motor 40 is connected to the bottom of the ice making water tank 24 through an inlet pipe 42, and the pumping motor 40 is configured so as to send ice making water W by pressure to the sprinkler 26 through a discharge pipe 44 to spray the ice making water W from each of the water sprinkling nozzles 28 on the corresponding ice making chamber 18. The ice making water which has not frozen yet in the ice making chamber 18 (unfrozen water) is then collected in the ice making water tank 24 to be circulated again.

A brief description is given for the operation of the ice making mechanism 10 according to the above-mentioned configuration. When the ice making operation starts, a coolant is circulated through the evaporation pipe 20 so as to cool the ice making chamber 18 forcibly. Also, the ice making water W in the ice making water tank 24 is sent by pressure by the pumping motor 40 so as to be supplied by spraying to the ice making chamber 18 through the water sprinkling nozzle 28. A part of the ice making water W is cooled on the inner surface of the ice making chamber 18 to start freezing in layers. In this case, the unfrozen water which has not frozen yet is collected in the ice making water tank 24. An ice block I is formed in the ice making chamber 18 as the ice making operation proceeds, which is detected by a required sensor, switching to the deicing operation, hot gas is supplied through the evaporation pipe 20 so as to warm the ice making chamber 18. The ice block I dropping down by separation from each of the ice making chambers 18 falls onto the ice chute 22 and slides off obliquely downwardly to be led to the opening 12*a*. The ice block I pushes the separator 14 open by its own weight so as to be discharged from the inside of the ice making section case 12 to an ice storage house (omitted in the drawing).

As described above, the end face 22*a* of the ice chute 22 facing the opening 12*a* of the ice making section case 12 is in tight contact with the inner face 14*a* of the separator 14 so that the ice making water W to be sprayed during the ice making operation is prevented from being scattered to the outside of the ice making section case 12 from the opening 12*a*. However, since the end face 22*a* of the ice chute 22 is in face contact with the inner face 14*a* of the separator 14 (see FIG. 14), the surface tension exerted on the ice making water W getting through the gap is relatively strong, so that the end face 22*a* of the ice chute 22 sometimes sticks to the inner face 14*a* of the separator 14. Therefore, the separator 14 cannot be opened by the weight of the ice block I during the deicing process of the ice block I, so that the ice block I is caught in the opening 12*a*. The ice block I caught in the opening 12*a* is deformed by getting the ice making water W thereon during the following ice making process and consequently, an ice block W of an expected shape cannot be obtained.

In contrast, in a structure in which the inner face 14*a* of the separator 14 is in no contact with the ice chute 22, the force of the scattered ice making water W rocks the separator 14, the ice making water W cannot be prevented from being scattered to the outside of the ice making section case 12. Specifically, the structure is disadvantageous in that the scattered ice making water W melts the ice block I retained in the ice storage house. Also, if the ice making water W which has not frozen yet cannot be collected in the ice making water tank 24, a decrease in the volume of ice making water required for a single ice making process causes a water shortage. It should be noted that if the tank 24 is extended so that the ice making water W leaking out of the gap between the separator 14 and the ice chute 22 can be received by the ice making water tank 24, there is a risk that the ice block I discharged from the opening 12*a* might be caught.

BRIEF SUMMARY OF THE INVENTION

The present invention, in view of the above-mentioned problems inherent in the ice discharging structure of the ice making mechanism according to the foregoing prior art, is proposed to solve them in a favorable manner, and it is an object of the present invention to provide an ice discharging structure of an ice making mechanism which effectively can prevent ice making water from being scattered out during the ice making operation, and reliably can discharge an ice block regardless of the weight of the ice block.

In order to overcome the above-mentioned problems and achieve the desired objectives, an ice discharging structure of an ice making mechanism according to the present invention comprises an ice making section case having an opening on one side thereof; an ice making section provided inside the ice making section case, cooled by an evaporation pipe, for forming an ice block from ice making water supplied circulatingly; an ice chute provided to be inclined below the ice making section, directing an inclined plane toward the opening, for slipping the ice block fallen from the ice making section down toward the opening; and a separator suspended rockably from the ice making section case, in contact with an end face of the ice chute normally so as to close the opening openably and closably, for discharging the ice block toward an ice storage house by pushing the ice chute out open by the slipped ice block, wherein:

a rib is provided on the inner face of the separator and/or the end face of the ice chute, being configured so that the inner face and the end face are in line or point contact with each other by the rib when the separator closes the opening.

DETAILED DESCRIPTION OF THE PREFERRED EMBODIMENTS

Figure 13:
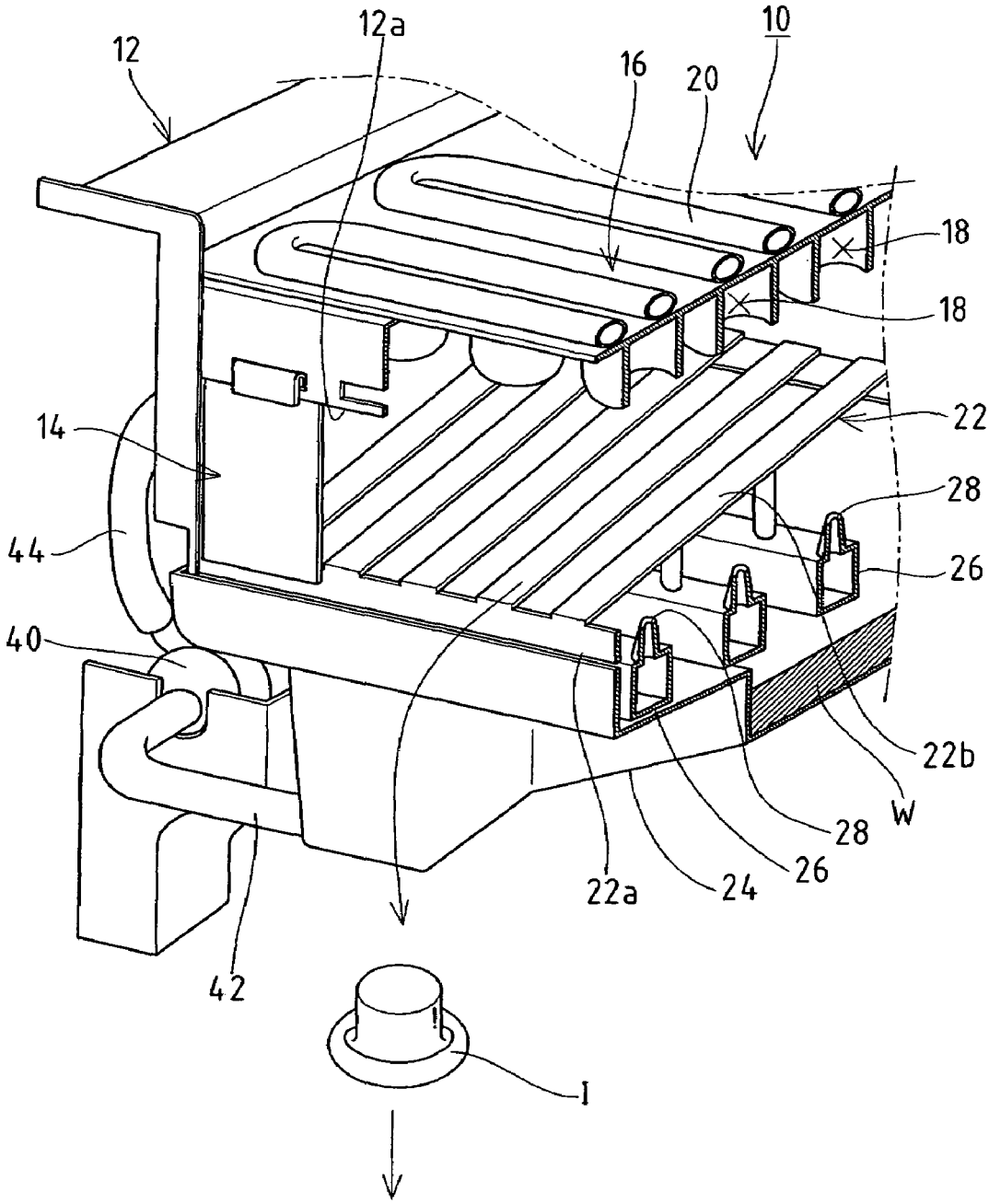
FIG. 13 (PRIOR ART)
FIG. 13 is a schematic perspective view showing an ice making mechanism of an ice making machine according to the prior art.
Figure 14:
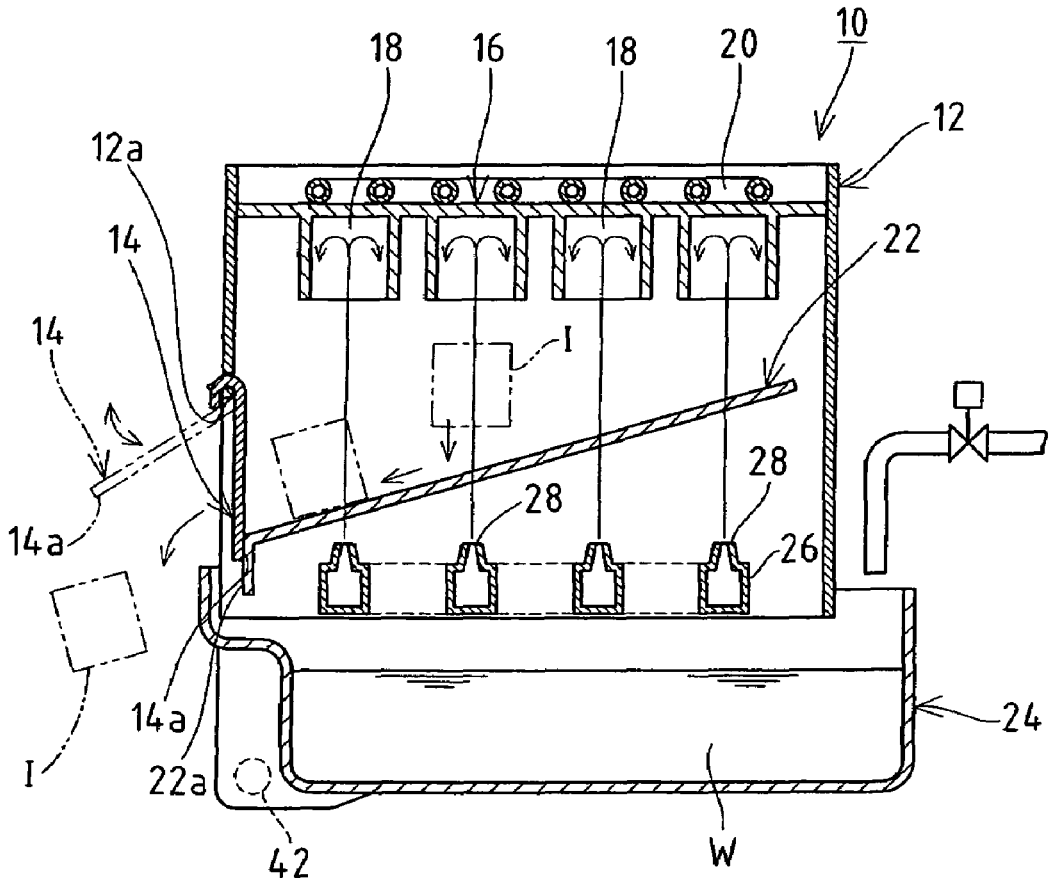
FIG. 14 (PRIOR ART)
FIG. 14 is a sectional side view showing the ice making mechanism of the ice making machine according to the prior art.

Next, an ice discharging structure of an ice making mechanism according to the present invention is described by way of preferred embodiments with reference to the accompanying drawings. It should be noted that the embodiments relate to a case in which the ice discharging structure of the ice making mechanism according to the present invention is applied to the automatic ice making machine described in the section of the prior art. Therefore, for purposes of description, the components identical to the components shown in FIG. 13 and FIG. 14 use the same reference numbers and the detailed description thereof is omitted here.

First Embodiment

Figure 1:
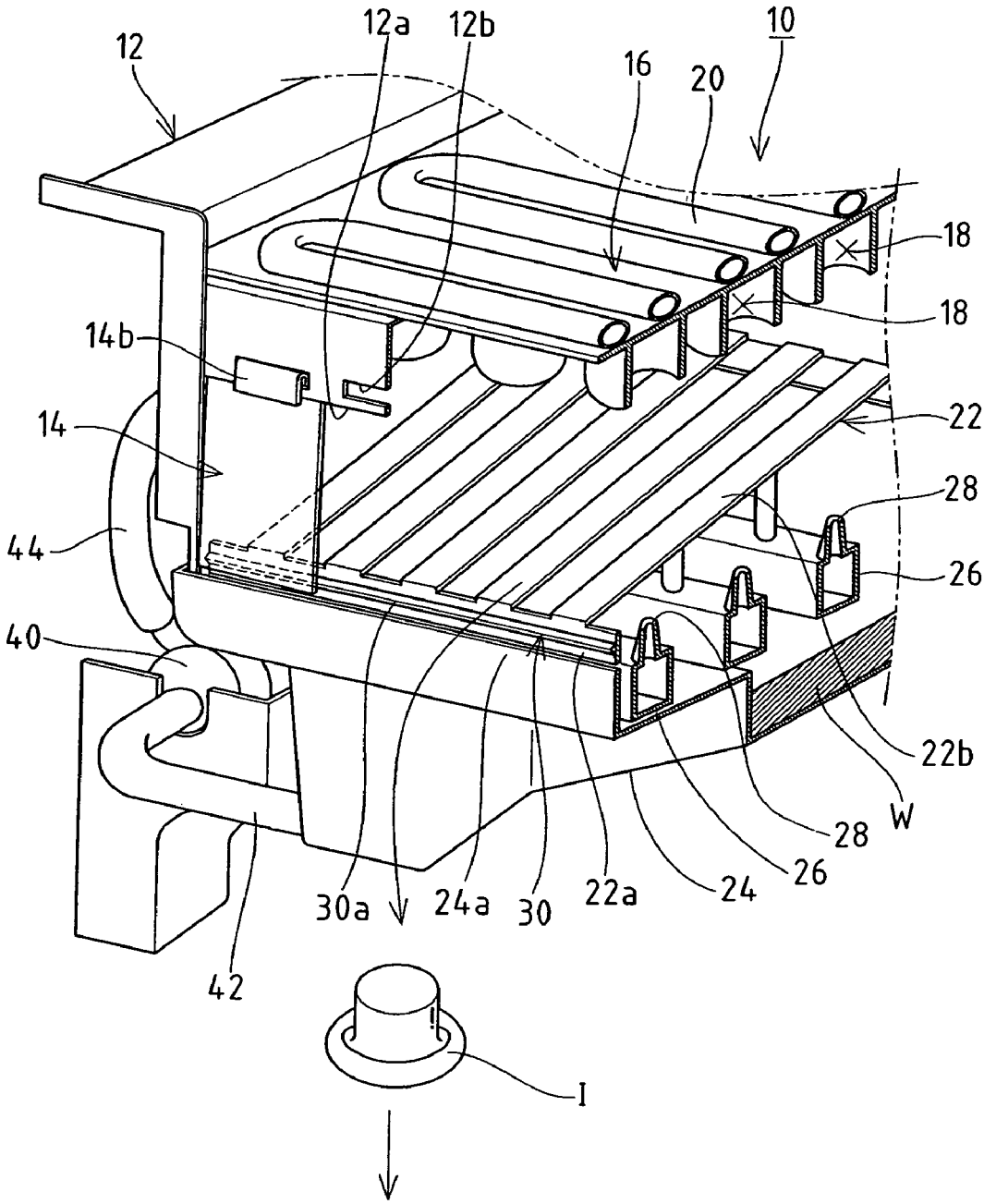
FIG. 1 is a schematic perspective view showing an ice making mechanism of an ice making machine according to a preferred first embodiment of the present invention.

As shown in FIG. 1, an ice making mechanism 10 of an ice making machine according to a first embodiment comprises an ice making section case 12 on one side of which an opening 12*a* is provided to be closed by a separator 14 openably and closably. In the ice making section case 12, there are provided an ice making section 16 in which a large number of ice making chambers 18 opening downward are implemented on the upper side; a sprinkler 26 having a water sprinkling nozzle 28 provided corresponding to each of the ice making chambers 18; and an ice chute 22 provided to be inclined downward to the opening 12*a* of the ice making section case 12, between the ice making section 16 and the sprinkler 26, for leading an ice block I fallen from the ice making chamber 18 into sliding off toward the opening 12*a*. Also, an ice making water tank 24 is provided below the ice making section case 12 for retaining a given volume of ice making water W and for collecting unfrozen water. The lower end portion of the ice making section case 12 is inserted in the ice making tank 24 so that the ice making water W supplied from the water sprinkling nozzle 28 to the ice making chamber 18 might not be scattered to the outside of the ice making section case 12 during the ice making process (see FIG. 2).

Figure 2:
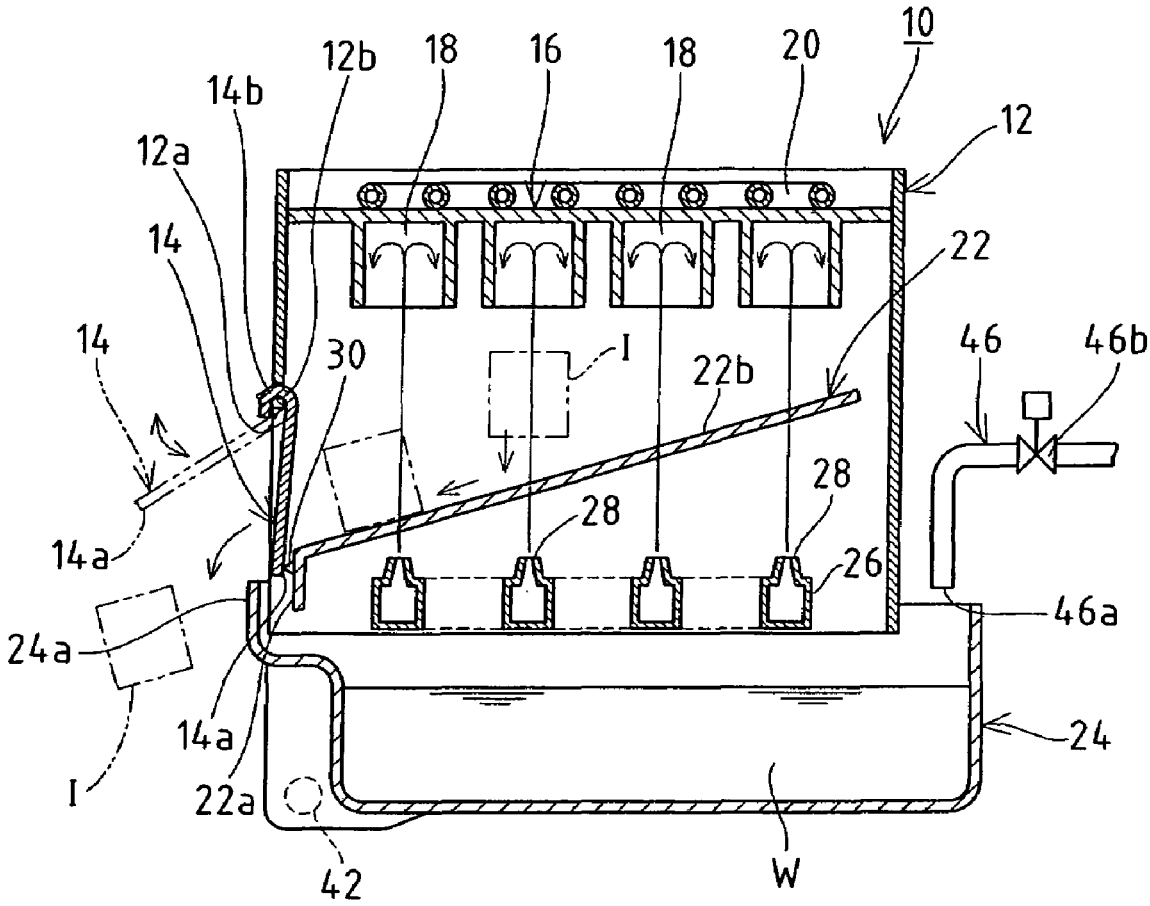
FIG. 2 is a sectional side view showing the ice making mechanism of the ice making machine according to the first embodiment.

On the top face of the ice making section 16, an evaporation pipe 20 communicated with a refrigerating system (not shown) is meanderingly arranged in tight contact so as to cool the ice making chamber 18 forcibly by circulating a coolant therethrough during the ice making operation and to encourage the ice block I to be separated by warming the ice making chamber 18 by hot gas after the ice making is completed. A pumping motor 40 for sending the ice making water W retained in the ice making water tank 24 by pressure to the water sprinkling nozzle 28 is provided adjacent to the lower side of the ice making water tank 24. The pumping motor 40, in which an inlet pipe 42 thereof is connected to the bottom of the ice making water tank 24 and a discharge pipe 44 is connected to the sprinkler 26, is configured so that the ice making water W taken in through the inlet pipe 42 is sent to the sprinkler 26 by pressure by driving the motor 40 and supplied to the ice making chamber 18 oppositely positioned upward by spraying. Furthermore, a water supply pipe 46 for filling up the ice making water tank 24 with tap water (ice making water), as shown in FIG. 2, is configured so that a water inlet 46*a* thereof faces the inside of the ice making water tank 24 from above in order to supply tap water by opening a water valve 46*b* inserted in the water supply pipe 46.

On one side wall of the ice making section case 12, an opening 12*a* is provided as an outlet for the ice block I, and a plurality of separators 14 hanged down, engaging the upper end portion thereof with the opening 12*a* rockably, are provided in parallel with the width direction of the opening 12*a*. The separator 14, which is a rectangular, flat plate-like member, comprises an engagement part 14*b* formed by bending into a C-shape at one end (upper end portion). The engagement part 14*b* of the separator 14 is inserted through a plurality of slits 12*b* of a required width provided at an interval in the width direction above the opening 12*a*, so as to hang the plurality of separators 14 down adjacently to each other through the width direction of the opening 12*a* attachably/removably and rockably, being normally hanged down by gravity. The lower end of the separator 14 is set to be positioned at least lower than the midpoint of the vertical width of the end face 22*a* of the ice chute 22. Specifically, when there is no ice block I slipping off along the ice chute 22, the separator 14 closes the opening 12*a* of the ice making section case 12 by bringing the lower end portion of the inner face 14*a* into contact with a first rib 30 (to be described later) provided on the end face 22*a* of the ice chute 22. When an ice block I falls from the ice chute 22, the separator 14 opens outward by the weight of the ice block I with the part where the engagement part 14*b* engages with the slit 12*b* as a supporting point (see FIG. 2).

Figure 3:
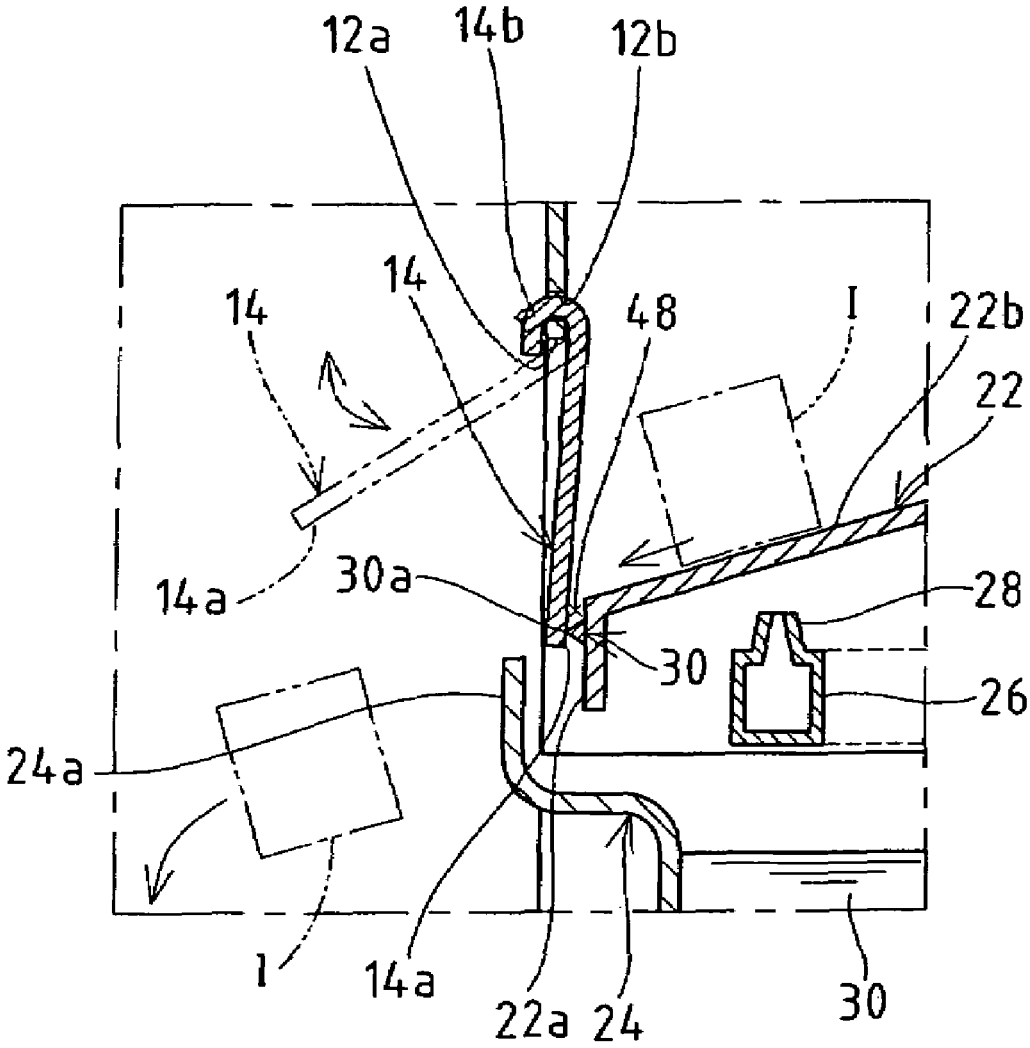
FIG. 3 is an enlarged view showing a major part of the ice discharging structure of the ice making mechanism according to the first embodiment.

The ice chute 22, which is a duckboard-like member, opens toward the water sprinkling nozzle 28 facing off against the ice making chamber 18, and sets a spacing so that neither the ice block I might fall from the gap nor the ice block I might be caught in the gap. Also, the end face 22*a* of the ice chute 22 facing the opening 12*a* of the ice making section case 12 is formed so as to drop down from a guide face (inclined plane) 22*b*, which is the top face of the ice chute 22, in a vertical direction. On the end face 22*a*, a first rib 30 with a triangular cross section is integrally provided extending horizontally through the width direction of the end face 22*a* (the width direction of the opening 12*a*). The vertical position for providing the first rib 30 relative to the end face 22*a* is set so that a top 30*a* thereof is in contact with the inner face 14*a* of the separator 14 and that the top 30*a* of the first rib 30 is positioned to be lower than an extension of the guide face 22*b*. Specifically, as shown in FIG. 3, above the contact part between the first rib 30 and the inner face 14*a*, a first space 48 implemented by the separator 14 and the end face 22*a* of the ice chute 22 is formed.

Below the separator 14, an outer edge 24*a* appears as a side wall of the ice making water tank 24, the contact part between the separator 14 and the end face 22*a* of the ice chute 22 faces an inner part of the ice making water tank 24, similarly to the lower end portion of another ice making section case 12. It should be noted that the outer edge 24*a*, which is positioned to be outer than the contact part, is set so as not to be caught when turning the separator 14 and discharging the ice block I.

Next, a description is given for the action of the ice discharging structure of the ice making mechanism according to the first embodiment. When starting an ice making operation, a coolant is circulated through the evaporation pipe 20 so as to cool the ice making chamber 18 forcibly. The ice making water W in the ice making water tank 24 is sent by pressure to the sprinkler 26 by the pumping motor 40, being supplied by spraying to each of the ice making chambers 18 through each of the water sprinkling nozzles 28. A part of the ice making water W is cooled on the inner surface of the ice making chamber 18 to start freezing in layers. An ice block I is then formed in the ice making chamber 18 as the ice making operation proceeds, which is detected by the required sensor, switching to the deicing operation.

The unfrozen water which drops down without freezing in the ice making chamber 18 during the ice making operation is collected in the ice making water tank 24 located below the ice making section case 12. Since the ice making section 16 is covered with the ice making section case 12 and the lower end portion of the ice making section case 12 is inserted in the ice making water tank 24, the ice making water W sprayed from the water sprinkling nozzle 28 and then scattered inside the ice making section case 12, is led to the ice making section tank 24. Furthermore, the ice making water W led to the first space 48 along the separator 14 or the guide face 22*b* of the ice chute 22 drops down along the first rib 30 into the ice making water tank 24 provided below, so that the ice making water W is not scattered outward from the opening 12*a*. Since the top 30*a* of the first rib 30 formed on the end face 22*a* of the ice chute 22 is in contact with the inner face 14*a* of the separator 14 in a line, the ice making water W led into the first space 48 gives a slight surface tension to attract each other. Therefore, the force of the scattered ice making water W does not rock the separator 14, thereby preventing the ice making water W from being scattered from the opening 12*a*.

Next, a valve provided in the refrigerating system is switched and hot gas is supplied through the evaporation pipe 20 so as to warm the ice making chamber 18, thereby separating the ice block I from the ice making chamber 18. The ice block I falls onto the ice chute 22 provided to be inclined, slides off obliquely downwardly and pushes the separator 14 provided in the side wall of the ice making section case 12 open, so as to be discharged from the inside of the ice making section case 12 to the ice storage house. When the ice block I is released from the ice making chamber 18, the separator 14 returns again to the original position by gravity so as to close the opening 12*a* of the ice making section case 12 again.

In the contact part between the separator 14 and the end face 22*a* of the ice chute 22, the top 30*a* of the first rib 30 with a triangular cross section formed on the end face 22*a* of the ice chute 22 is in contact with the inner face 14*a* of the separator 14 in a line. Specifically, the contact area of the contact part becomes smaller thereby reducing the impact of the surface tension of the ice making water W getting through between the top 30*a* and the inner face 14*a*. Therefore, even a lightweight ice block I can push the separator 14 open, thereby achieving a reliable discharging of the ice block I from the ice making section case 12. In addition, since the separator 14 is pushed open, a momentum does not have to be given to the ice block I, and the height of the ice making section case 12 can be lower by decreasing the gradient angle of the ice chute 22.

Second Embodiment

Figure 4:
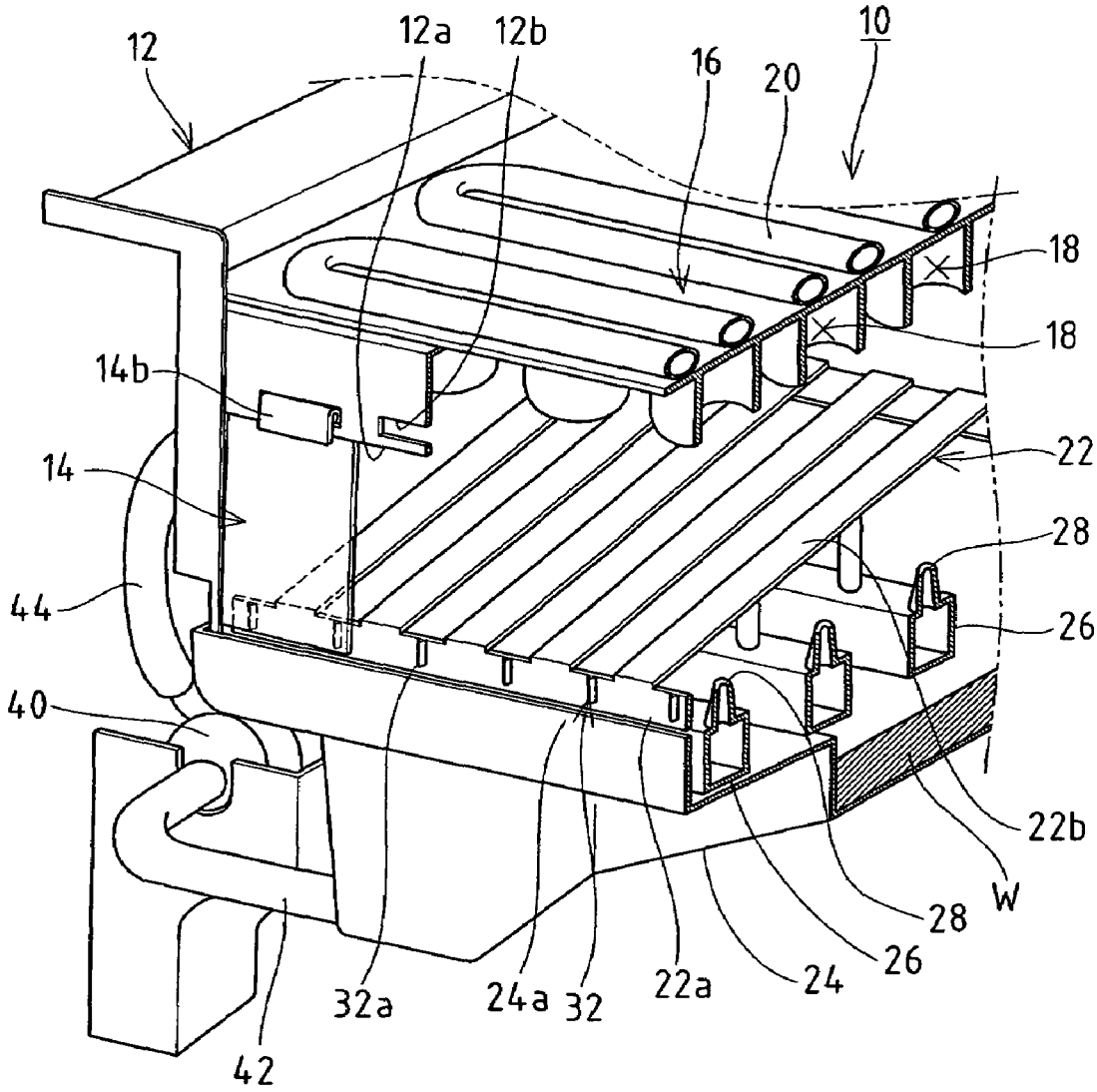
FIG. 4 is a schematic perspective view showing an ice making mechanism of an ice making machine according to a second embodiment.
Figure 5:
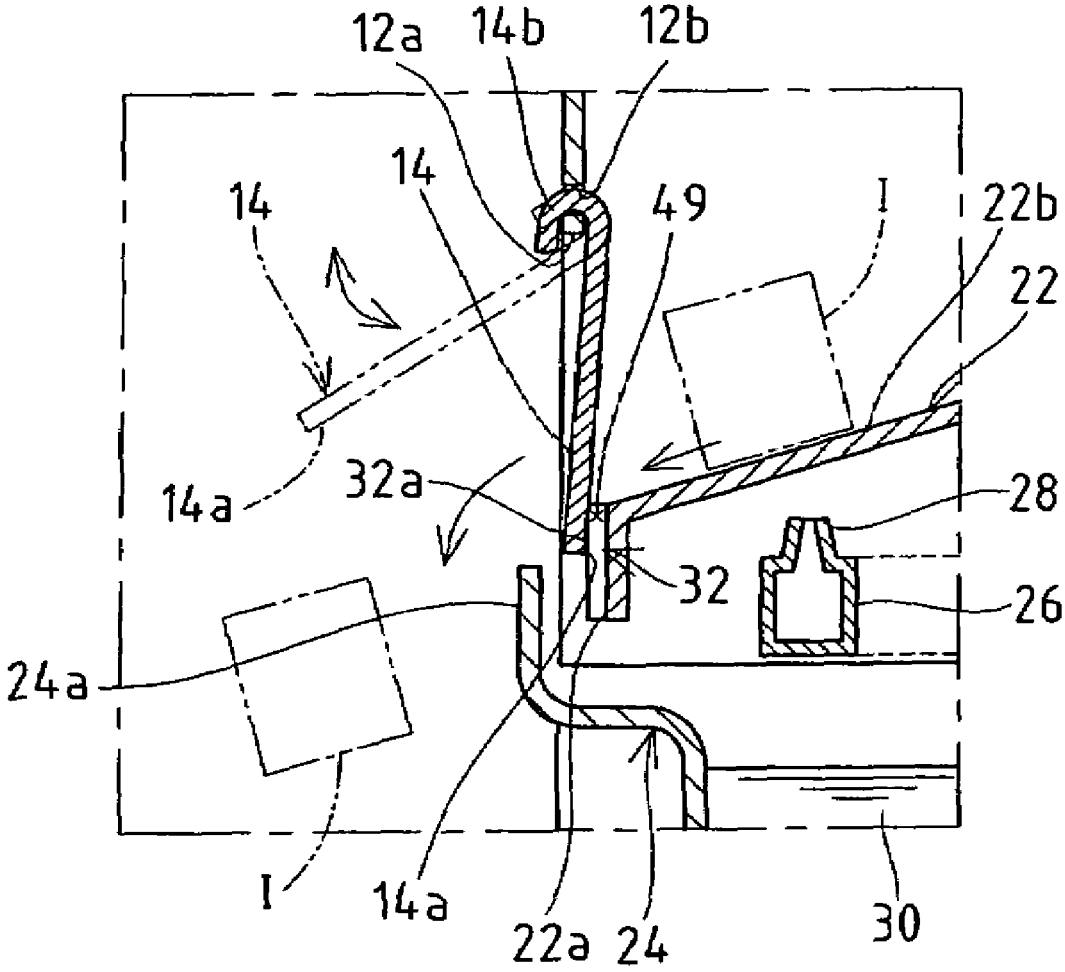
FIG. 5 is an enlarged view showing a major part of the ice discharging structure of the ice making mechanism according to the second embodiment.

FIG. 4 or FIG. 5 shows an ice discharging structure according to a second embodiment. On the end face 22*a* of the ice chute 22 facing the opening 12*a* of the ice making section case 12, a plurality of second ribs 32 extending vertically are provided at a required interval in the width direction of the end face 22*a*, and tops 32*a* thereof and an inner face 14*a* of a separator 14 are configured so as to be in contact with each other. The second rib 32 is formed to have a triangular cross section, and the top 32*a* of the second rib 32 is in line contact with the inner face 14*a* of the separator 14. Between the inner face 14*a* of the separator 14 and the end face 22*a* of the ice chute 22, a second space 49 is formed between the adjacent second ribs 32, 32. Specifically, the ice making water W sprayed out in the ice making section case 12, led by the guide face 22*b* of the ice chute 22 or the separator 14, is collected in the ice making water tank 24 through the second space 49. Specifically, no ice making water W gathers between the inner face 14*a* of the separator 14 and the end face 22*a* of the ice chute 22, thereby causing no excess surface tension to be exerted.

Third Embodiment

Figure 6:
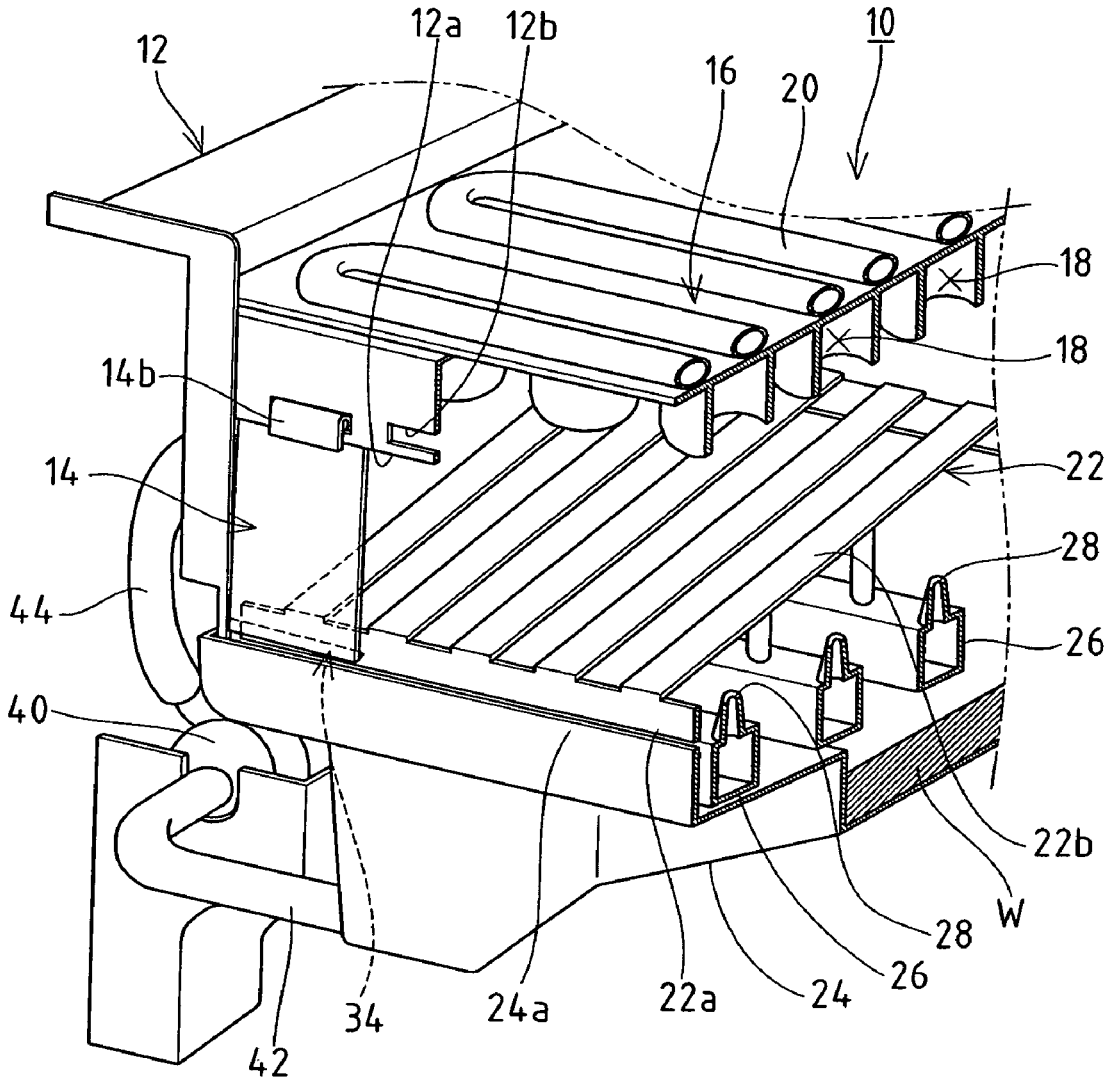
FIG. 6 is a schematic perspective view showing an ice making mechanism of an ice making machine according to a third embodiment.
Figure 7:
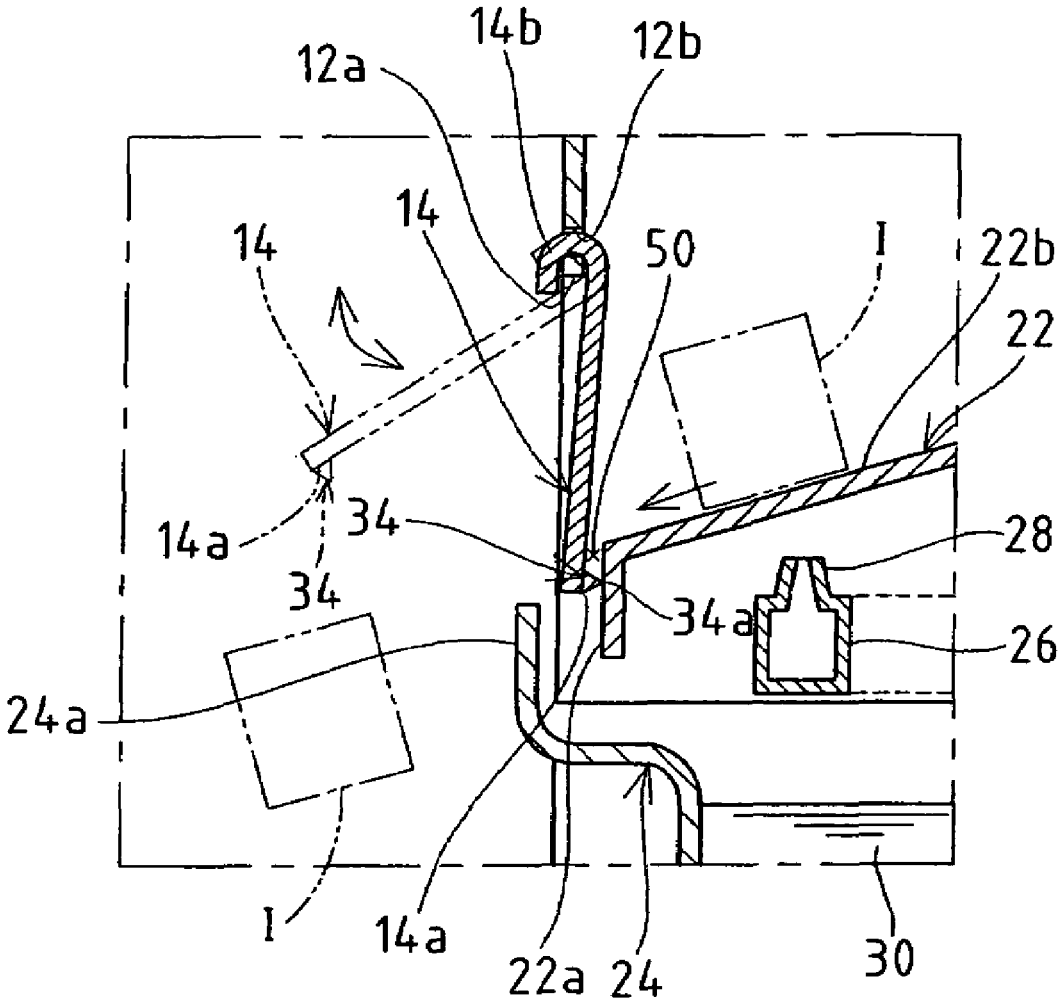
FIG. 7 is an enlarged view showing a major part of the ice discharging structure of the ice making mechanism according to the third embodiment.

FIG. 6 or FIG. 7 shows an ice discharging structure according to a third embodiment. On the inner face 14*a* of the separator 14, through the width direction thereof, a third rib 34 is provided, being configured so that the top 34*a* of the third rib 34 is in contact with the end face 22*a* of the ice chute 22. The third rib 34 is formed to have a triangular cross section, and the top 34*a* of the third rib 34 is in line contact with the end face 22*a* of the ice chute 22 facing the opening 12*a* of the ice making section case 12. Specifically, since the contact area of the contact part is small, the impact of the surface tension of the ice making water W getting through between the top 34*a* and the inner face 14*a* can be reduced. Also, a third space 50 is formed between the inner face 14*a* of the separator 14 and the end face 22*a* of the ice chute 22. Specifically, the ice making water W sprayed out in the ice making section case 12, led by the guide face 22*b* of the ice chute 22 or the separator 14, entering the third space 50, is discharged along the third rib 34 so as to be collected in the ice making water tank 24. It should be noted that the third rib 34 provided on the separator 14 side discharges the ice making water W led to the ice making water tank 24 more inward to the tank 24, thereby reducing a risk that the ice making water W might be scattered to an ice storage house even if the ice making water W splashes at a bottom of the ice making water tank 24.

Figure 8:
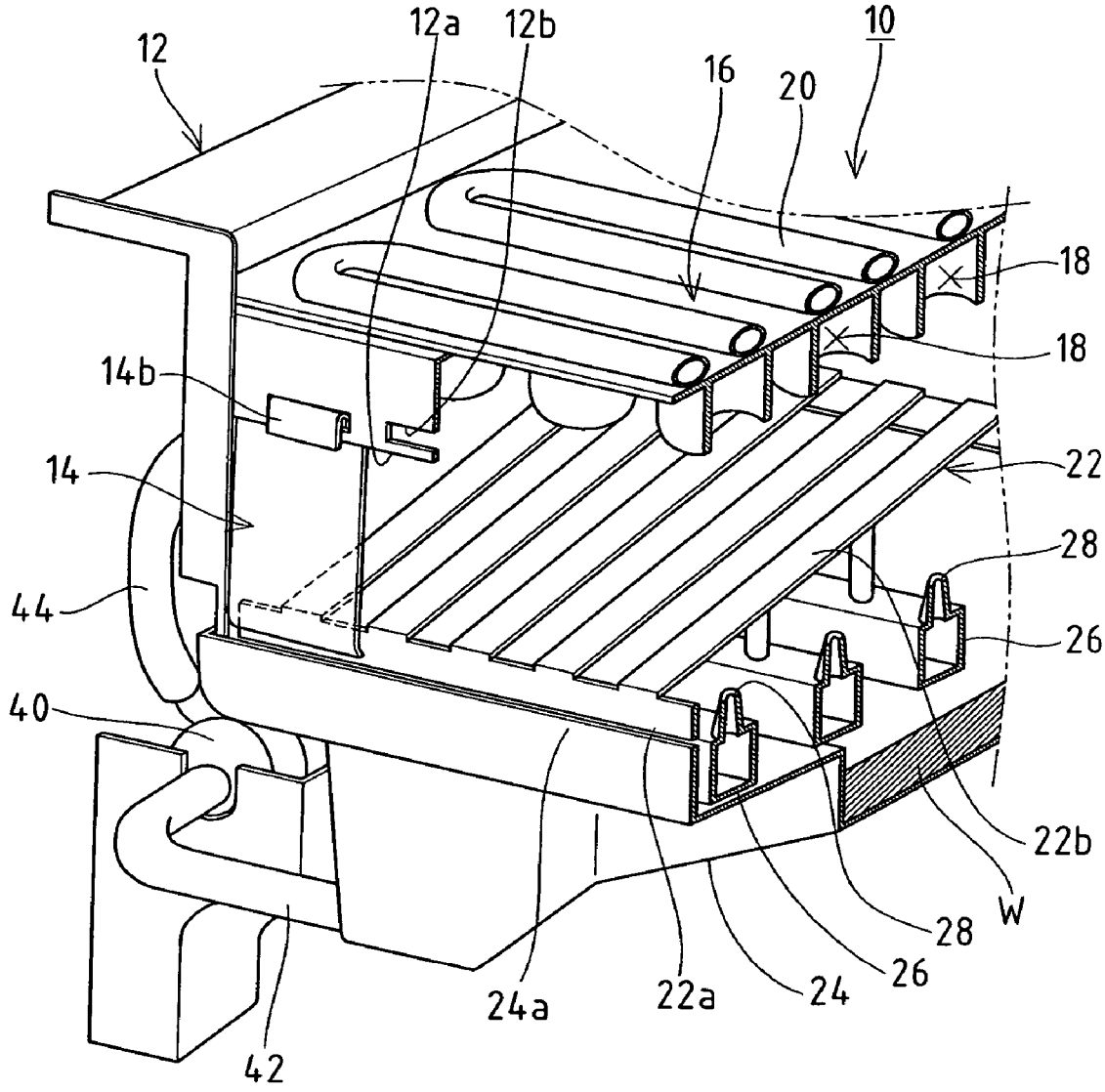
FIG. 8 is a schematic perspective view showing an ice making mechanism of an ice making machine according to a modified embodiment of the third embodiment.
Figure 9:
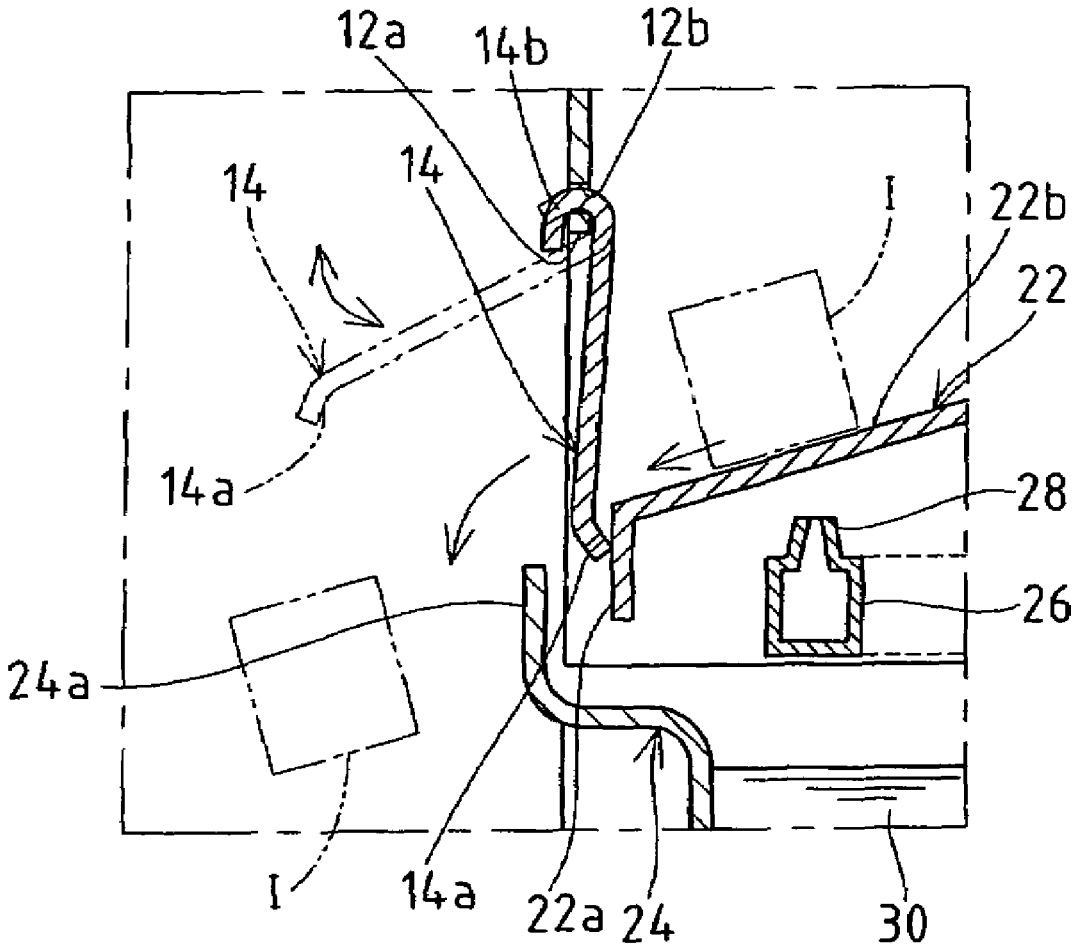
FIG. 9 is an enlarged view showing a major part of the ice discharging structure of the ice making mechanism according to the modified embodiment of the third embodiment.

In addition, as shown in FIG. 8 or FIG. 9, as a modified embodiment of the third embodiment, a configuration in which the lower end portion of the separator 14 is bent so as to be in contact with the end face 22*a* of the ice chute 22 can also be employed. In this case, the angle made between the lower end face of the separator 14 and the surface facing the opening 12*a* is in line contact with the end face 22*a*.

Fourth Embodiment

Figure 10:
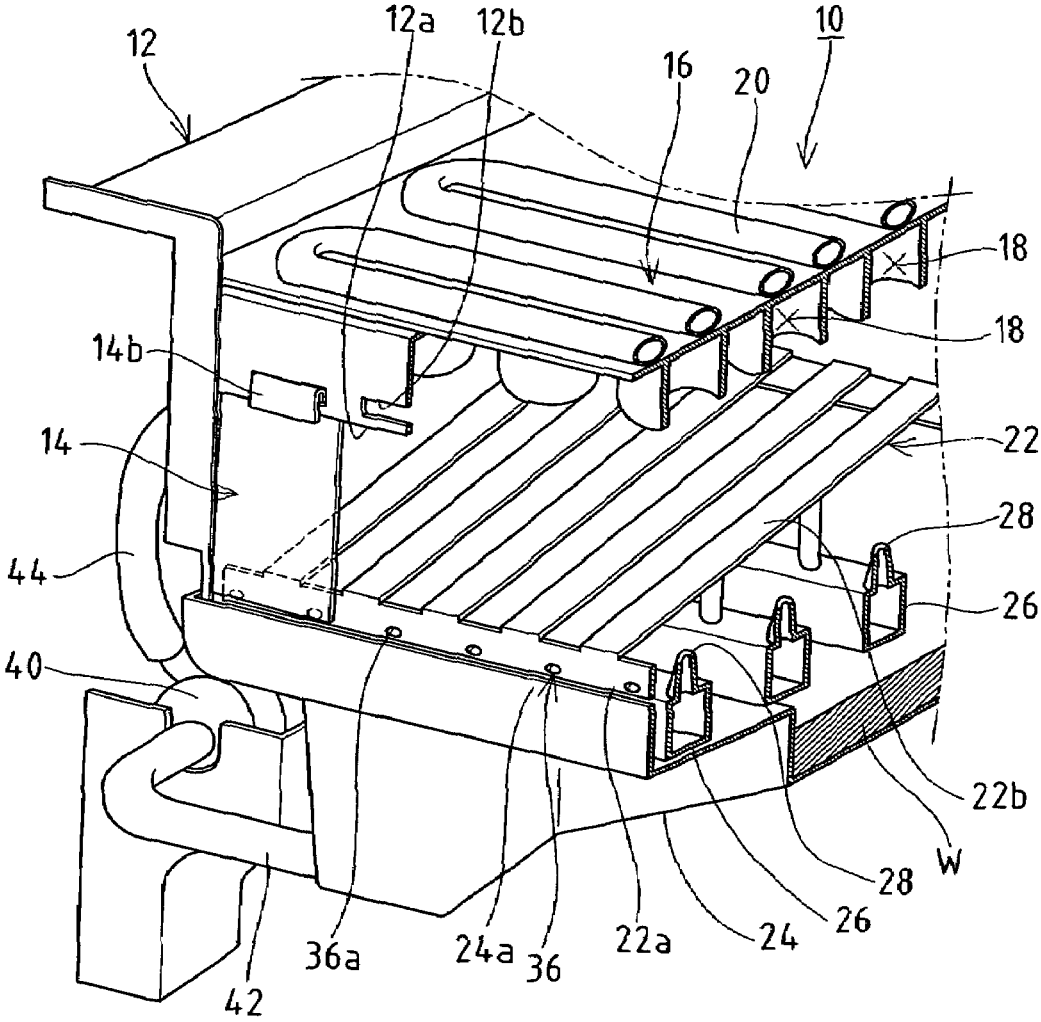
FIG. 10 is a schematic perspective view showing an ice making mechanism of an ice making machine according to a fourth embodiment.
Figure 11:
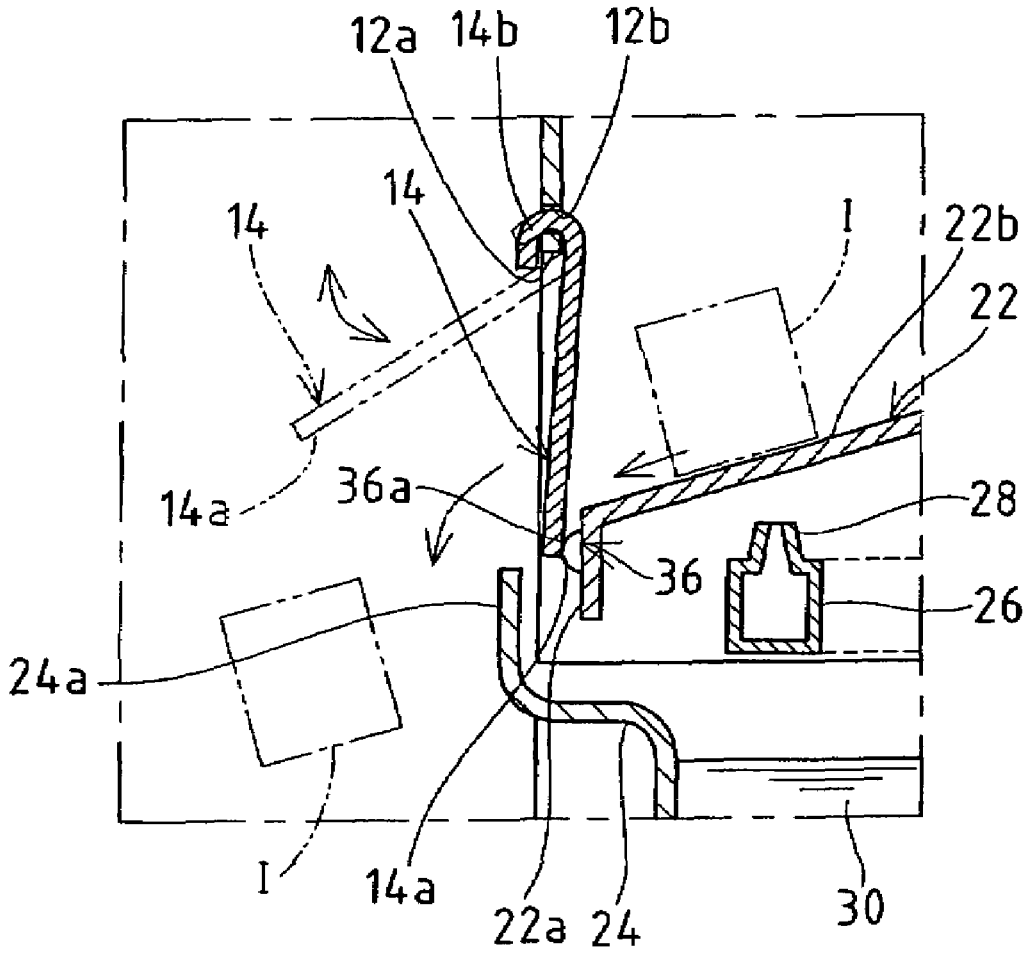
FIG. 11 is an enlarged view showing a major part of the ice discharging structure of the ice making mechanism according to the fourth embodiment.

FIG. 10 or FIG. 11 shows an ice discharging structure according to a fourth embodiment. On the end face 22*a* of the ice chute 22, a plurality of convex pieces 36 are provided at an interval as a rib in the width direction, being configured so that the tops 36*a* thereof are in contact with an inner face 14*a* of a separator 14. The convex piece 36 has a semicircular appearance like a cap inverted on the end face 22*a*, and the top 36*a* of the convex piece 36 is in point contact with the inner face 14*a* of the separator 14. Specifically, the contact area of the contact part can become further smaller, thereby further reducing the impact of the surface tension of the ice making water W entering between the top 36*a* and the inner face 14*a*.

Figure 12:
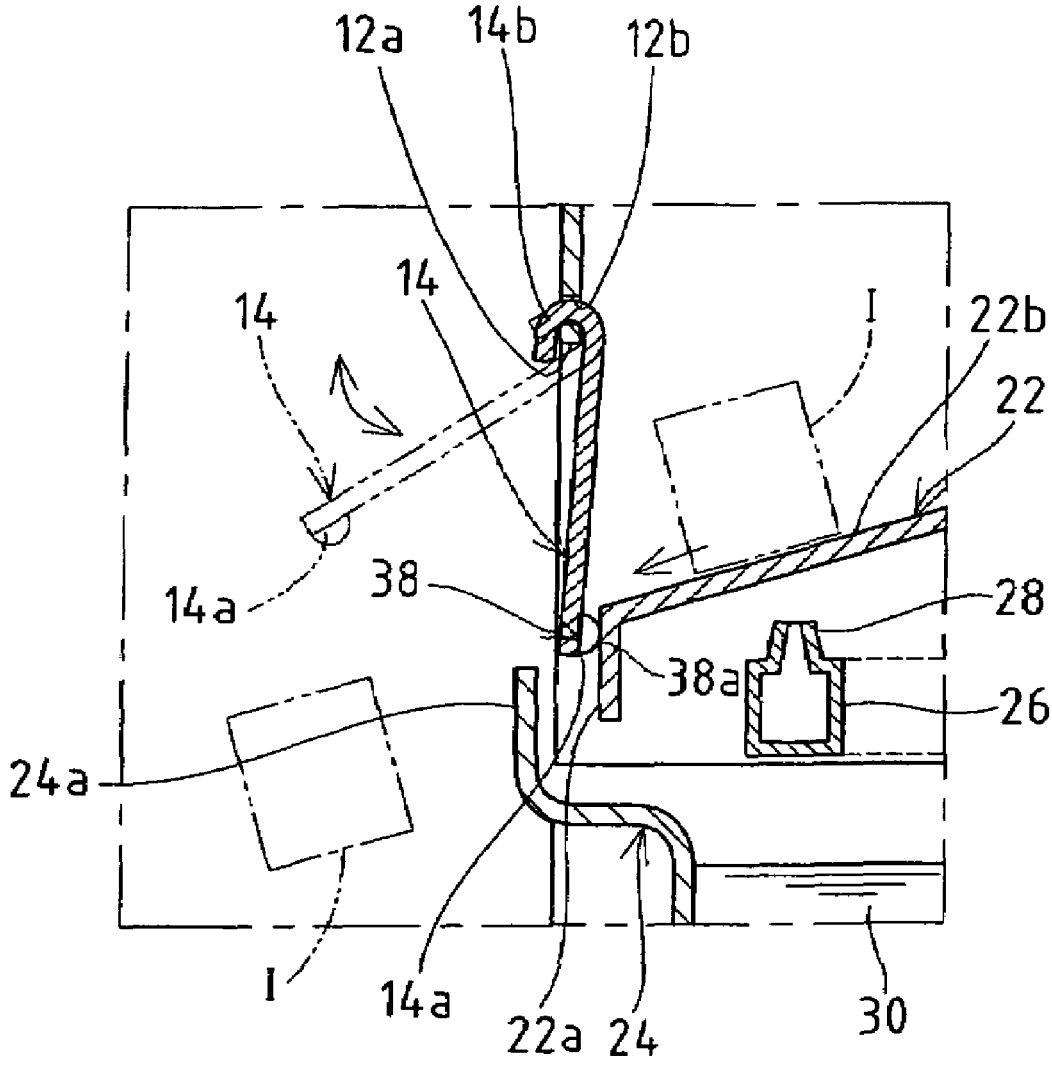
FIG. 12 is an enlarged view showing a major part of an ice discharging structure of an ice making mechanism according to a modified embodiment of the fourth embodiment.

Furthermore, as shown in FIG. 12, as a modified embodiment of the fourth embodiment, a configuration in which a convex piece (rib) 38 is provided on the inner face 14*b* of the separator 14 so as to bring the top 38*a* of the convex piece 38 into point contact with the end face 22*a* of the ice chute 22 is also available.

Furthermore, a configuration in which a triangular rib or semicircular convex piece is provided on both the inner face 14*b* of the separator 14 and the end face 22*a* of the ice chute 22 can also be employed. It should be noted that, in this case, the rib and rib, the rib and convex piece, or the convex piece and convex piece, which are located in the contact part between the inner face 14*b* and the end face 22*a*, should be set so as not to overlap each other.

As has been described above, according to the ice discharging structure of the ice making mechanism according to the present invention, the inner face of the separator and the end face of the ice chute are in contact with each other through the rib, thereby making the contact area of the contact part smaller. Therefore, during the ice making operation, a slight surface tension exerted on the contact part maintains a closed state in the opening of the ice making section case, thereby effectively preventing ice making water from being scattered to the outside. Also, during the deicing operation, by making the surface tension exerted on the contact part slighter, the ice block can be discharged reliably regardless of its weight.

What is claimed is:

1. An ice discharging structure of an ice making mechanism, the ice making mechanism comprising an ice making section case having an opening on one side thereof; an ice making section provided inside the ice making section case, cooled by an evaporation pipe, for forming an ice block from ice making water supplied circulatingly; an ice chute provided to be inclined below said ice making section, directing an inclined plane toward said opening, for slipping the ice block fallen from the ice making section down toward the opening; and a separator suspended rockably from said ice making section case, in contact with an end face of said ice chute normally so as to close said opening openably and closably, for discharging the ice block toward an ice storage house by pushing said ice chute out open by the slipped ice block, wherein:

a plurality of ribs extending vertically and at an interval in a width direction provided on the end face of said ice chute or an inner face of said separator, and when said ribs contact said inner face of said separator or said end face of said ice chute, a space allowing the ice making water to pass through is formed between said inner face of said separator and said end face of said ice chute.

2. The ice discharging structure of the ice making mechanism according to claim 1, wherein each of said plurality of ribs is a triangular rib extending vertically, and a top thereof is in line contact with the inner face of said separator or the end face of the ice chute.

3. An ice discharging structure of an ice making mechanism, the ice making mechanism comprising an ice making section case having an opening on one side thereof;

an ice making section provided inside the ice making section case, cooled by an evaporation pipe, for forming an ice block from ice making water supplied circulatingly;

an ice chute provided to be inclined below said ice making section, directing an inclined plane toward said opening, for slipping the ice block fallen from the ice making section down toward the opening; and a separator suspended rockably from said ice making section case, in contact with an end face of said ice chute normally so as to close said opening openably and closably, for discharging the ice block toward an ice storage house by pushing said ice chute out open by the slipped ice block, wherein on the end face of said ice chute or the inner face of said separator, a plurality of convex pieces are provided at an interval in a width direction, and tops thereof are in point contact with the inner face of said separator or the end face of the ice chute.

* * * * *